US005709917A

United States Patent [19]

Carmien

[11] Patent Number: 5,709,917

[45] Date of Patent: Jan. 20, 1998

[54] HYDRAULIC SOLID ROD FOR USE IN, FOR EXAMPLE, TRENCH SHIELDS

[76] Inventor: Joseph Allen Carmien, 525 N. Maple Dr., Beverly Hills, Calif. 90210

[21] Appl. No.: 691,347

[22] Filed: Aug. 2, 1996

[51] Int. Cl.[6] ..... B32B 1/00

[52] U.S. Cl. ..... 428/36.3; 138/140; 156/166; 156/180; 156/433; 156/441; 264/129; 428/35.7; 428/36.1

[58] Field of Search ..... 156/166, 180, 156/433, 441; 264/129; 138/140; 428/35.7, 36.1, 36.3

[56] References Cited

U.S. PATENT DOCUMENTS

| | | | |
|---|---|---|---|
| Re. 32,364 | 2/1987 | Carmien | 294/57 |
| T101,401 | 1/1982 | Zion | 264/25 |
| 2,571,717 | 10/1951 | Howald et al. . | |
| 3,291,878 | 12/1966 | Boggs . | |
| 3,378,884 | 4/1968 | Meteer . | |
| 3,567,541 | 3/1971 | Kaczerginski . | |
| 3,619,009 | 11/1971 | O'Leary . | |
| 4,063,838 | 12/1977 | Michael . | |
| 4,236,386 | 12/1980 | Yates et al. | 64/15 |
| 4,238,540 | 12/1980 | Yates et al. . | |
| 4,300,321 | 11/1981 | Preis et al. . | |
| 4,440,593 | 4/1984 | Goldsworthy | 156/441 |
| 4,469,541 | 9/1984 | Goldsworthy | 156/180 |
| 4,570,988 | 2/1986 | Carmien | 294/57 |
| 4,605,254 | 8/1986 | Carmien | 294/57 |
| 4,639,029 | 1/1987 | Kolonia | 294/57 |
| 4,673,541 | 6/1987 | Watanabe et al. | 264/25 |
| 4,739,536 | 4/1988 | Bandera et al. | 16/111 R |
| 4,752,313 | 6/1988 | Allaire et al. | 65/18.1 |
| 4,770,834 | 9/1988 | Nakasone et al. | 264/127 |
| 4,772,438 | 9/1988 | Watanabe et al. | 264/25 |
| 4,803,819 | 2/1989 | Kelsey | 52/309.1 |
| 4,820,366 | 4/1989 | Beever et al. | 156/166 |
| 5,264,060 | 11/1993 | Lambing et al. | 156/180 |
| 5,421,931 | 6/1995 | Carmien | 156/172 |

FOREIGN PATENT DOCUMENTS

| | | |
|---|---|---|
| 2831318 | 2/1979 | Germany . |

*Primary Examiner*—James J. Bell

*Attorney, Agent, or Firm*—Kelly Bauersfeld Lowry & Kelley, LLP

[57] ABSTRACT

A hollow composite rod manufactured in a pultrusion manufacturing process includes a hollow interior space that may be filled with a liquid, such as water or oil, and subsequently sealed to greatly increase the strength of a resultant rod assembly. The composite rod includes a high strength, pultruded fiber-resin jacket that, at each end, is molded about a reinforced insert to create a fluid-tight seal therebetween. Threaded access apertures are provided through either the reinforced inserts or the jacket itself, to permit the filling or draining of fluid relative to the hollow interior space. Reinforcing sleeves or caps may be molded over a portion of the jacket's exterior to improve the composite rod's resistance to cutting and chipping-type damage.

22 Claims, 2 Drawing Sheets

HYDRAULIC SOLID ROD FOR USE IN, FOR EXAMPLE, TRENCH SHIELDS

BACKGROUND OF THE INVENTION

This invention relates generally to fiber-resin composite pultrusion methods and products. More particularly, the present invention relates to a composite rod which has a fluid-tight hollow interior space that may be filled with a liquid, such as water or oil, at a job site and subsequently sealed to greatly increase the strength of the rod.

In manufacturing composite rods, a variety of competing design considerations are at stake. On the one hand it is desirable to have a rod that is as light as possible to provide for easy transport and use by consumers. On the other hand the rod must have the structural integrity to withstand the variety of stresses that will be placed on it.

The basic technique for running filaments through a resin bath and then through an elongated heated die tube .to produce a cured composite rod of the same shape as the die tube has been known for some time. See, for example, U.S. Pat. Nos. 2,948,649 and 3,556,888. This method, however, produces a solid extruded product which is unacceptably heavy and/or too rigid for many applications.

The weight problem can be alleviated by means of a process to extrude hollow tubes utilizing a die tube with the center filled, leaving an annular cross-section through which the resin coated fibers are pulled. This weight reduction is achieved, however, at the cost of significantly reduced bending or flexural strength in comparison with a solid rod, resulting in a rod which would not be suitable for use in certain high stress applications. Further, to increase inter-laminar strength of the tube forming fibers, a substantial percentage of fibers running other than in a longitudinal direction have been thought to be required.

The bending strength of composite rods can be improved by producing fiber-resin rods which are substantially hollow or lightweight throughout a major portion of their length, but reinforced at areas of expected high stresses during use. Such improved rods and related methods are shown, in connection with tool handles, in U.S. Pat. No. 4,570,988, the contents of which are incorporated herein by reference. These composite tool handles have further been improved by the introduction of one or more reinforcing beads of fiber-resin material extending the length of the load bearing rod, as shown in U.S. Pat. No. 4,605,254, the contents of which are incorporated herein by reference.

Such composite rods have further been improved by introducing corrugations in the outer surface of the fiber-resin jacket during the pultrusion process. More particularly, one or more external mold members may be channeled into the pultrusion die tube in the space between the die tube and the resin coated fibers to shape the outer surface of the jacket. Similar processes are utilized to modify the internal configuration of the fiber-resin jacket as well. See, for example, U.S. Pat. No. 5,421,931, the contents of which are incorporated herein by reference.

There remain applications in which high strength rods are utilized, but wherein composite rods have heretofore been thought to be unacceptably expensive or lacking the required strength characteristics to be utilized in such applications. One such application is in connection with trench shields. Trench shields are used in all sorts of construction in which a trench must be dug, for example, in connection with laying large pipe for sewers, conduit or building foundations. Trench shields come in a wide assortment of sizes to accommodate trenches typically ranging in size from twenty four inches in width to one hundred eight inches in width.

Trench shield side walls or panels of appropriate size and strength for the depth of the trench are placed on either side of the trench to preclude cave-ins, both for the safety of the workers and to preclude the necessity of having to re-dig the trench if the sides cave in. These panels are held in position by cross bars, or spreader bars, of appropriate length and strength. Hardware, such as spreader bar support brackets, is affixed to each end of the spreader bar to provide a mating attachment between a respective end of the spreader bar and the adjacent portion of the side wall or panel.

At the present time virtually all spreader bars are made of heavy walled steel tubing. The principal shortcoming of utilizing such heavy walled steel tubing is the weight thereof. The heavy weight of such steel tubing is a negative as it substantially increases the cost of shipping and, as the spreader bars get larger and longer, the workmen cannot handle it and mount it in place by hand, but must use a piece of equipment such as a back hoe, crane or some other piece of equipment. This is slow, time consuming and expensive for the contractor who would normally prefer to have an adequately strong spreader bar which could be handled by one man in most instances.

Spreader bars must have the compressive strength to resist bending or breaking from the loads created by the side panels holding back the walls of the trench. They must also be rugged and stout enough to take the occasional abuse of the rough and tumble crew and its equipment. The inherent strength, weight, toughness and non-corrosive characteristics of fiberglass composite rod make it an ideal material for this application. Certain design problems present themselves, however, particularly if a fiberglass tube is used. The resistance of a fiberglass tube to having its circular hoop integrity damaged is much greater than steel as it is not nearly as stiff. The flexural modulus of a fiberglass tube is in the order of magnitude of five to six million, while steel is in excess of fifteen million. Additionally, the resistance to dinging and abuse of a fiberglass tube is lower than that of steel.

Accordingly, there is a need for an alternative to heavy walled steel tubing in applications such as for use in trench shields, which incorporate the advantages of fiberglass composite rods and yet maintain the structural and strength characteristic of such heavy walled steel tubing. Fiberglass composite rods utilized in such high strength applications must have improved resistance to dinging, and means for improving their circular hoop integrity to approximate that of steel tubing. Moreover, such high strength fiberglass composite rod is needed which is relatively lightweight for transportation, storage and handling at the job site. The present invention fulfills these needs and provides other related advantages.

SUMMARY OF THE INVENTION

The present invention resides in a composite rod assembly manufactured in a pultrusion manufacturing process to include a fluid-tight hollow interior space that may be selectively filled with a liquid to transform the rod assembly into an hydraulic solid rod. A process for manufacturing such a composite rod assembly includes the steps of alternately introducing a first reinforced core, an elongated hollow tube and a second reinforced core into a pultrusion die tube, surrounding the reinforced cores and the hollow tube with resin-coated fibers, pulling the reinforced cores and the hollow tube through the pultrusion die tube while keeping the reinforced cores and the hollow tube surrounded by the resin-coated fibers, and curing the resin-coated fibers around the reinforced cores and the hollow tube to form a fiber-resin jacket. The hollow interior space is defined as the volume within the hollow tube between the reinforced cores. Means also provided for accessing the hollow interior space in order to introduce a liquid therein or to drain a liquid therefrom, and for re-sealing the hollow interior space thereafter. Utilizing the foregoing basic pultrusion manufacturing process, a composite rod assembly is formed which includes a elongated pultruded jacket of fiber-resin material which has a first end and second end. The pair of reinforced cores are disposed within the fiber-resin jacket at the first and second ends thereof such that they form a fluid-tight seal with the fiber-resin jacket.

In a preferred form of the invention, a molded protective sleeve encases the fiber-resin jacket. This molded protective sleeve provides means for protecting the jacket against cutting and chipping-type damage. At least one of the reinforced cores comprises a tubular, interiorly threaded insert about which the fiber-resin jacket is molded, and an end plug having a threaded shaft that is received within the threaded insert. The end plug includes a head flange. The reinforced core further includes an O-ring disposed between the head flange and a facing end of the threaded insert in order to provide a fluid seal therebetween. The threaded insert and the end plug provide the hollow interior space accessing means in that removal of the end plug from the insert permits access to the hollow interior space, and replacement of the end plug into the threaded insert re-seals the hollow interior space.

In another preferred form of the invention, the composite rod assembly includes a molded protective cap which encases each end of the fiber-resin jacket. Like the protective sleeve, the protective cap provides means for protecting the jacket against cutting and chipping-type damage. In this embodiment, at least one of the reinforced cores comprises a substantially solid fiber-resin insert about which the fiber-resin jacket is molded during the pultrusion manufacturing process. The hollow interior space accessing means comprises an access aperture through a portion of the fiber-resin jacket. The rod assembly further includes a threaded insert disposed adjacent to the access aperture and aligned therewith for receiving a threaded shaft of a sealing plug.

In both illustrated embodiments, the steps of removing the end plug or sealing plug from the respective threaded insert, introducing a liquid through the threaded insert into the hollow interior space until said space is completely filled, and replacing the end plug or sealing plug into the respective threaded insert to reseal the hollow interior space, transforms the rod assembly into an hydraulic solid rod.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
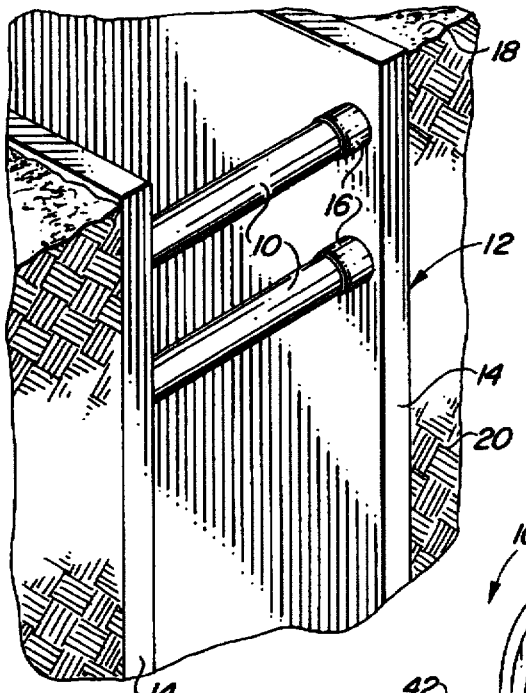
FIG. 1 is fragmented perspective view of a trench shield in use, utilizing a pair of spreader bars embodying the present invention.
Figure 3:
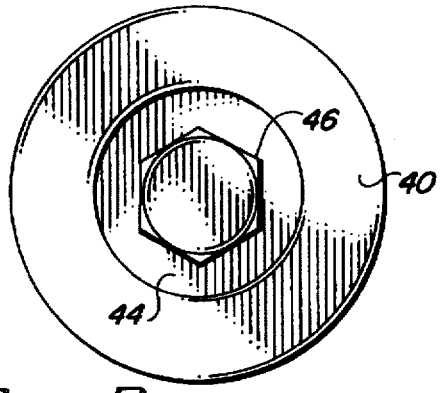
FIG. 3 is an enlarged elevational view of an end of the spreader bar illustrated in FIG. 2.
Figure 2:
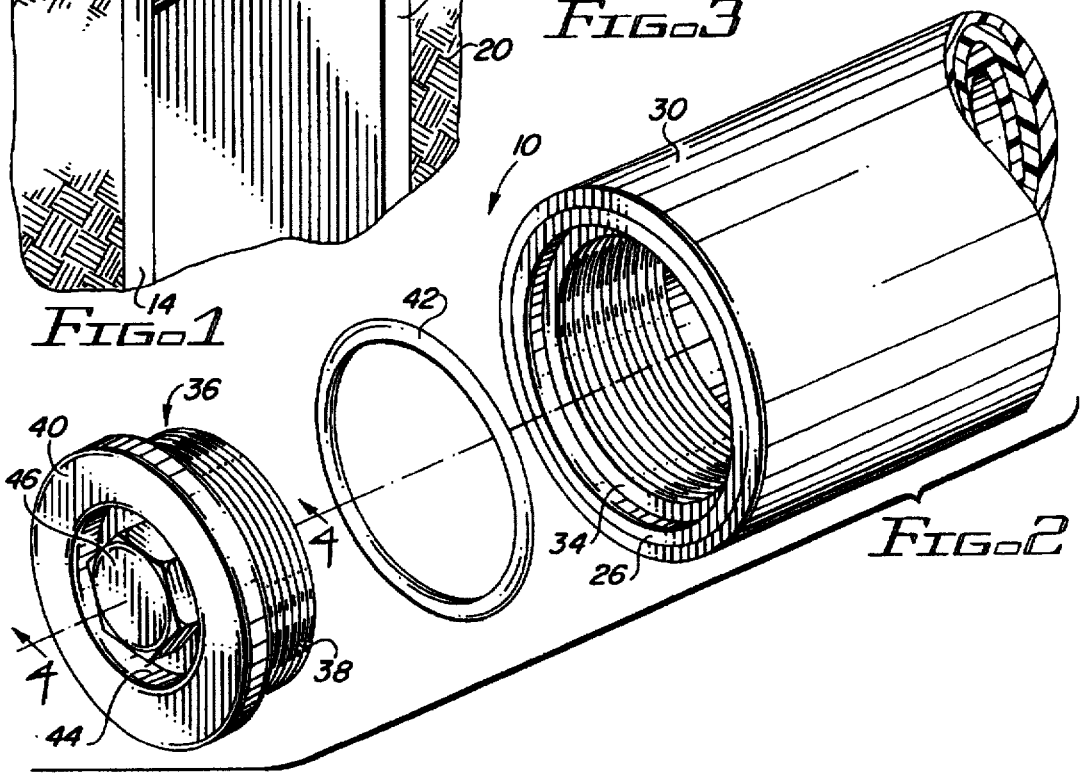
FIG. 2 is an enlarged fragmented exploded perspective view of one end of a spreader bar illustrated in FIG. 1.
Figure 4:
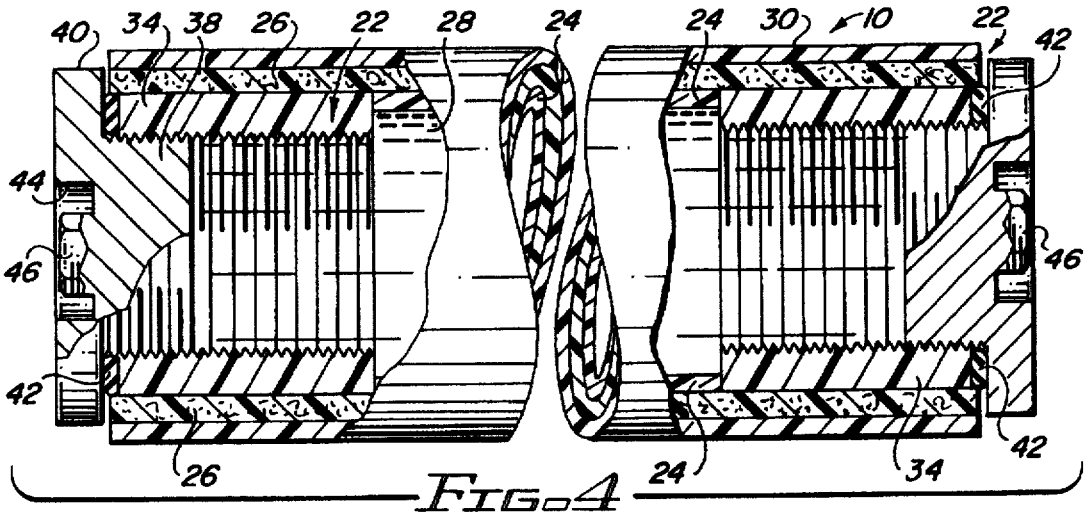
FIG. 4 is an enlarged, fragmented and partially sectional view of the spreader bar of FIGS. 13, taken generally along the line 4—4 of FIG. 2.

As shown in the drawings for purposes of illustration, the present invention is concerned with an hydraulic solid rod, generally designated in the accompanying drawings by the reference number 10. The hydraulic solid rod 10 may be utilized as, for example, a spreader bar in a trench shield 12. Such trench shields 12 normally include a plurality of spreader bars 10 fixed at opposite ends to trench shield side walls 14 by means of support brackets 16. The trench shield side walls 14 are typically placed below a ground surface 18 adjacent to earthen walls 20 of a trench, to prevent their collapse (see FIG. 1).

In accordance with the present invention, the spreader bar 10 is manufactured, at least in part, by a pultrusion process and includes alternating sections of a heavy duty, reinforced core 22 and hollow plastic tubing 24 surrounded by a cured fiber-resin jacket 26. The reinforced core 22 is located at each end of the spreader bar 10 and is configured to provide a fluid-tight seal between the fiber-resin jacket 26 and a hollow interior 28 of the spreader bar 10. The hollow plastic tubing 24 extends through the remainder of the spreader bar (hydraulic solid rod) 10 to minimize the weight of the spreader bar and also to define the hollow interior 28. A protective sleeve 30 may be molded over the exterior of the fiber-resin jacket 26 to improve the spreader bar's resistance to cutting and chipping-type damage. Alternatively, a protective cap 32 may be molded over the ends of the spreader bar 10 for the same purpose.

To manufacture the spreader bar 10, a fiber material is drawn off a series of spools or bails and then passed through a resin bath and through a carding disk into a pultrusion die tube where the fibers surround the alternating sections of reinforced core 22 and the hollow plastic tubing 24. The resin coated fibers are pulled through the die tube and are heated and cured about the cores 22 and 24 by a conventional conduction heater or a microwave heating element which surrounds the die tube. The cured rod (or spreader bar 10), consisting of the fiber-resin jacket 26 surrounding the core sections 22 and 24, is pulled out of the die tube by tractor-type pullers and cut into the desired length by a conventional cutting device. Such a pultrusion manufacturing process is well known in the art. See, for example, U.S. Pat. No. 4,570,988.

In one preferred embodiment of the spreader bar shown in FIGS. 2–5(A, B and C), the reinforced core 22 comprises means for gaining access to the hollow interior 28 through an end of the spreader bar 10. In this regard, the reinforced core 22 comprises an interiorly threaded metal insert 34 which is placed in abutting relation with the hollow plastic tubing 24 and spaced so as to be positioned at each end of the resultant spreader bar 10. The metal insert 34 is surrounded by the resin-coated fibers during the pultrusion manufacturing process so that the fiber-resin jacket 26 forms a bond with an exterior surface of the metal insert 34. An end plug 36 includes a threaded shaft 38 that may be screwed into the insert 34. The end plug 36 further includes a head flange 40 which is capable of compressing an O-ring between the head flange and an exposed end of the insert 34 for purposes of insuring a fluid-tight seal between the end plug 36 and the threaded metal insert 34. The end plug 36 also includes an exterior recess 44 in which is positioned a hex head 46 to facilitate turning of the end plug 36 by means of, for example, a socket wrench.

The fiber-resin jacket 26 is encased by a PVC sleeve which forms the protective sleeve 30 mentioned above. This particular arrangement results in a spreader bar 10 which is relatively lightweight (in comparison with metal tubes), and which can thus be transported and handled conveniently by a lone workman.

In order to increase the strength of the spreader bar 10 at the job site for high-strength applications such as use as spreader bar 10 in a trench shield 12, one of the end plugs 36 is removed to expose the hollow interior 28. The hollow interior 28 is filled with a liquid, normally water (see FIG. 5A), and when the hollow interior 28 is completely filled with the selected liquid, the end plug 36 is replaced (see FIG. 5B). The resultant hydraulic solid rod 10 comprises a hollow bar filled with a liquid and corked. The hydraulic principle acts as though it were a solid throughout inasmuch as pressure created upon the incompressible fluid is transmitted in all directions without diminishing. This precludes the tube from having its circular integrity compromised. Thus, with the hollow interior 28 filled with the liquid 48, the hydraulic solid rod 10 is ready to be utilized as a spreader bar (see FIG. 5C).

Figures 5A, 5B, 5C, 6:
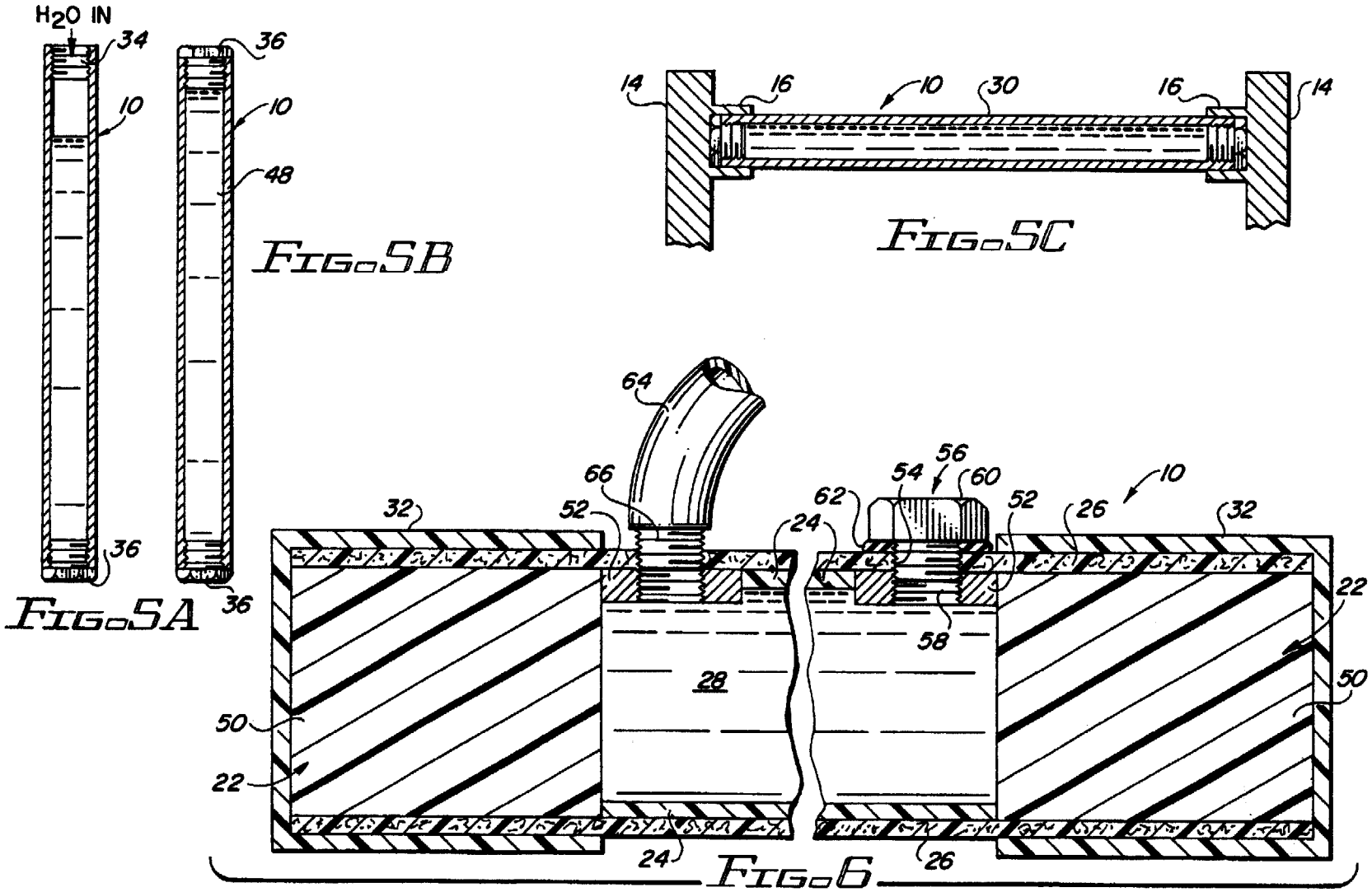
FIG. 5A is a schematic vertical sectional view of the spreader bar of FIGS. 1–4, illustrating the step of filling a hollow interior of the spreader bar with water.
FIG. 5B is a vertical sectional view of a spreader bar similar to that shown in FIG. 5A, illustrating the step of replacing an end plug once the hollow interior of the spreader bar has been filled with water.
FIG. 5C illustrates the step of placing the water-filled spreader between two trench shield side walls.
FIG. 6 is an enlarged fragmented sectional view of another embodiment of a spreader bar embodying the present invention, wherein threaded access apertures to the hollow interior of the spreader bar are provided through a side wall rather than through the ends thereof.

In another preferred embodiment of the invention shown in FIG. 6, the reinforced core 22 comprises a solid fiber-resin insert plug 50 similar to the reinforcing core sections of U.S. Pat. No. 4,570,988. The fiber-resin insert plugs 50 are drawn through the pultrusion die tube with the hollow plastic tubing 24 such that as the resin-coated fibers cured to form the fiber-resin jacket 26, a fluid-tight seal is formed between the fiber-resin jacket 26 and insert plugs 50 as well as the hollow plastic tubing 24. In this embodiment, however, a metal threaded insert 52 is interposed between adjacent ends of the fiber-resin insert plug 50 and a hollow plastic tubing 24. A plug (not shown) may be threaded into the metal threaded insert 52, which has an exterior surface that will abut the interior of the pultrusion die tube. The fiber-resin jacket 26 is then molded to provide an access aperture 54 therethrough an alignment with an aperture of the metal threaded insert 52. This access aperture 54, two of which are provided, allows liquid to be inserted into the hollow interior 28 or withdrawn therefrom for purposes of filling or draining the spreader bar 10 as desired. The access aperture 54 may be sealed by a plug 56 that includes a threaded shaft 58 received into the insert 52, and a hex head 60. An O-ring 62 is provided between the hex head 60 and adjoining exterior surface of the fiber-resin jacket 26 to ensure a fluid-tight seal. When the plug 56 is removed from the access aperture 54, a filler hose 64 having a threaded coupling 66 may be utilized to fill the hollow interior 28 of the spreader bar 10 with liquid under pressure.

In this particular embodiment, a glass-filled nylon protective cap 32 is molded over each end of the solid rod 10. This protective cap 32 provides the desired resistance to dinging, cutting and chipping-type damage to the solid rod, especially as the ends of the hydraulic solid rod/spreader bar 10 are received within support brackets 16.

From the foregoing it will be appreciated that an un-filled hydraulic solid rod 10 constructed in accordance with the present invention will have a weight approximately twenty-five to thirty percent of a comparable steel bar. Thus, the unfilled hydraulic solid rod 10 will be easily handled by one or perhaps two men for installation on the job site. On reaching the job site the workmen need only to fill the hollow interior 28 with a liquid to increase the strength of the hydraulic solid rod 10. Normally water is sufficient, but in applications where the rod 10 will be permanent or semipermanent, another liquid could be substituted for the water, such as oil.

When the contractor is ready to remove the rod 10 from the job site, such as when the trench shield 12 is to be dismantled, the liquid 48 within the hollow interior 28 is drained so that the weight of the rod 10 is greatly reduced for storage and/or trans-shipment. In the case of the embodiment of the solid rod 10 including access apertures 54 through a wall of the fiber-resin jacket 26, it is preferred that the rod 10 be rotated so that the access apertures 54 point downwardly. At the end of construction the water can be drained quite easily in this configuration.

By molding the reinforced core 22 continuously with the hollow plastic tubing 24 in such a manner that the fiber-resin jacket 26 forms a seal between the tubing 24 and the core 22, a fluid-tight interior 28 is achieved in a highly efficient manner designed to reduce costs to a minimum.

Although several embodiments of the invention have been described in detail for purposes of illustration, various modifications may be made without departing from the spirit and scope of the invention. Accordingly, the invention is not to be limited, except as by the appended claims.

I claim:

1. A composite rod assembly manufactured in a pultrusion manufacturing process to include a fluid-tight hollow interior space that may be selectively filled with a liquid to transform the rod assembly into an hydraulic solid rod, the composite rod assembly comprising:

an elongate pultruded jacket of fiber-resin material, the fiber-resin jacket having a first end and a second end;

a pair of reinforced cores disposed within the fiber-resin jacket at the first and second ends thereof and forming a fluid-tight seal therebetween, wherein the hollow interior space is defined within the fiber-resin jacket between the reinforced cores; and means for accessing the hollow interior space in order to introduce a liquid therein or to drain a liquid therefrom, and for re-sealing the hollow interior space thereafter.

2. The rod assembly of claim 1, including a molded protective sleeve encasing the fiber-resin jacket.

3. The rod assembly of claim 1, including a molded protective cap encasing each end of the fiber-resin jacket.

4. The rod assembly of claim 1, including a hollow tube about which the fiber-resin jacket is molded, disposed between the reinforced cores, wherein the hollow interior space is defined as a volume within the hollow tube between the reinforced cores.

5. The rod assembly of claim 1, wherein at least one of the reinforced cores comprises a tubular, interiorly threaded insert about which the fiber-resin jacket is molded, and an end plug having a threaded shaft that is received within the threaded insert, wherein the threaded insert and the end plug further provide the hollow interior space accessing means in that removal of the end plug from the insert permits access to the hollow interior space, and replacement of the end plug into the threaded insert reseals the hollow interior space.

6. The rod assembly of claim 5, wherein the end plug includes a head flange, and the reinforced core further includes an O-ring disposed between the head flange and a facing end of the insert in order to provide a fluid seal therebetween.

7. The rod assembly of claim 1, wherein at least one of the reinforced cores comprises a substantially solid fiber-resin insert about which the fiber-resin jacket is molded during the pultrusion manufacturing process.

8. The rod assembly of claim 1, wherein the hollow interior space accessing means comprises an access aperture through a portion of the fiber-resin jacket.

9. The rod assembly of claim 8, including a threaded insert disposed adjacent to the access aperture and aligned therewith for receiving a threaded shaft of a sealing plug.

10. A composite rod assembly manufactured in a pultrusion manufacturing process to include a fluid-tight hollow interior space that may be selectively filled with a liquid to transform the rod assembly into an hydraulic solid rod, the composite rod assembly comprising:

an elongate pultruded jacket of fiber-resin material, the fiber-resin jacket having a first end and a second end;

a first reinforced core disposed within the fiber-resin jacket at the first end thereof and forming a fluid-tight seal therebetween;

a second reinforced core disposed within the fiber-resin jacket at the second end thereof and forming a fluid-tight seal therebetween;

hollow tubing disposed within the fiber-resin jacket and extending between the first and second reinforced cores, wherein the hollow interior space is defined as a volume within the hollow tubing between the reinforced cores;

means molded over at least a portion of the fiber-resin jacket, for protecting the jacket against cutting and chipping-type damage; and means for accessing the hollow interior space in order to introduce a liquid therein or to drain a liquid therefrom, and for re-sealing the hollow interior space thereafter.

11. The rod assembly of claim 10, including a molded protective sleeve encasing the fiber-resin jacket.

12. The rod assembly of claim 11, wherein at least one of the first or second reinforced cores comprise a tubular, interiorly threaded insert about which the fiber-resin jacket is molded, and an end plug having a threaded shaft that is received within the threaded insert, wherein the threaded insert and the end plug further provide the accessing means in that removal of the end plug from the insert permits access to the hollow interior space, and replacement of the end plug into the threaded insert reseals the hollow interior space.

13. The rod assembly of claim 10, including a molded protective cap encasing each end of the fiber-resin jacket.

14. The rod assembly of claim 13, wherein at least one of the first or second reinforced cores comprises a fiber-resin insert plug about which the fiber-resin jacket is molded during the pultrusion manufacturing process.

15. The rod assembly of claim 14, wherein the hollow interior space accessing means comprises an access aperture through a portion of the fiber-resin jacket, the rod assembly further including a threaded insert disposed adjacent to the access aperture and aligned therewith for receiving a threaded shaft of a sealing plug.

16. A process for manufacturing a composite rod assembly to include a fluid-tight hollow interior space that may be selectively filled with a liquid to transform the rod assembly into an hydraulic solid rod, comprising the steps of:

alternately introducing a first reinforced core, an elongate hollow tube and a second reinforced core into a pultrusion die tube;

surrounding the reinforced cores and the hollow tube with resin-coated fibers;

pulling the reinforced cores and the hollow tube through the pultrusion die tube while keeping the reinforced cores and the hollow tube surrounded by the resin-coated fibers; and curing the resin coated fibers around the reinforced cores and the hollow tube to form a fiber-resin jacket;

wherein the hollow interior space is defined as a volume within the hollow tube between the reinforced cores, and wherein means are provided for accessing the hollow interior space in order to introduce a liquid therein or to drain a liquid therefrom, and for resealing the hollow interior space thereafter.

17. The process of claim 16, including the step of molding a protective sleeve over the fiber-resin jacket.

18. The process of claim 17, including the steps of utilizing an interiorly threaded insert as at least one of the reinforced cores, wherein the insert threadably receives an end plug therein, removal of the end plug from the threaded insert permits access to the hollow interior space, and wherein reattachment of the end plug to the threaded insert re-seals the hollow interior space.

19. The process of claim 18, including the steps of removing the end plug from the threaded insert, introducing a liquid through the threaded insert into the hollow interior space until said space is completely filled, and replacing the end plug into the threaded insert to re-seal the hollow interior space, to transform the rod assembly into an hydraulic solid rod.

20. The process of claim 16, including the step of molding a protective cap over at least one end of the fiber-resin jacket.

21. The process of claim 20, including the steps of utilizing a substantially solid fiber-resin insert as at least one of the reinforced cores, and further providing an access aperture through a portion of the fiber-resin jacket, wherein the access aperture threadably receives a sealing plug therein, removal of the sealing plug from the access aperture permits access to the hollow interior space, and wherein the attachment of the sealing plug to the access aperture re-seals the hollow interior space.

22. The process of the claim 21, including the steps of removing the sealing plug from the access aperture, introducing a liquid through the access aperture into the hollow interior space until said space is completely filled, and replacing the sealing plug into the access aperture to re-seal the hollow interior space, to transform the rod assembly into an hydraulic solid rod.

* * * * *